United States Patent [19]

Michalson

[11] 4,080,519

[45] Mar. 21, 1978

[54] PRESSURE-OPERATED TAPE SWITCHES

[76] Inventor: George M. Michalson, 23198 Cedar Point Rd., Brook Park, Ohio 44142

[21] Appl. No.: 602,975

[22] Filed: Aug. 8, 1975

[51] Int. Cl.[2] ..... H01H 13/16

[52] U.S. Cl. ..... 200/86 R

[58] Field of Search ..... 200/85 R, 86 R, 159 B, 200/61.43, 61.57; 338/96; 340/272, 280; 29/622; 174/117 F; 156/51, 54, 55, 206, 202, 226, 227

[56] References Cited

U.S. PATENT DOCUMENTS

| | | | |
|---|---|---|---|
| B 579,104 | 1/1976 | Demler, Jr. | 200/159 B |
| 2,138,549 | 11/1938 | Labell | 200/86 |
| 2,843,694 | 7/1958 | Bertaux | 200/61.43 |
| 3,610,887 | 10/1971 | Betzer | 338/96 |
| 3,626,350 | 12/1971 | Suzuki et al. | 338/96 |
| 3,886,335 | 5/1975 | Hendricks | 200/159 B |

FOREIGN PATENT DOCUMENTS

| | | | |
|---|---|---|---|
| 465,069 | 4/1937 | United Kingdom | 200/86 |

*Primary Examiner*—David Smith, Jr.

[57] ABSTRACT

A monitoring device in the form of a ribbon or tape switch used to detect the distance an object is hit out in a field or open area. The switch consists of two conductor contacts mounted continuously on an insulated synthetic material to provide electrical continuity when an object touches it or rolls across it. The switch is sensitive enough to close from the weight of one ounce avoirdupois. The switch is constructed with a low profile angular shape so an object can roll over it without impeding its destination. The switch is made of simple enough construction to allow economic large scale manufacturing.

11 Claims, 5 Drawing Figures

VIEW A-A

PRESSURE-OPERATED TAPE SWITCHES

BACKGROUND

This invention relates to pressure operated ribbon or tape switches and satisfies a need for an economical switch with continuous contacts along its length and sensitive to weight down to one ounce avoirdupois. Its simple construction makes it possible to monitor large areas economically. The switch consists of two conductor contacts mounted continuously on an insulated synthetic material to provide electrical continuity when the insulated material is flexed by an external force. The physical size and type of conductor contacts, insulator material and the conductors related position on the insulator may be varied to alter the pressure sensitivity and electrical characteristics of the switch and its design applications. Changing the physical size and characteristics of the switch does not alter the manufacturing techniques and therefore the simple fabrication techniques are maintained to keep manufacturing cost at a minimum. All components necessary for the construction of this switch are inexpensive and readily available in bulk form which is also a factor in keeping the price down.

LIST OF DRAWINGS

DESCRIPTION OF TAPE SWITCH, APPLICATION AND MANUFACTURING PROCESS

Figure 1:
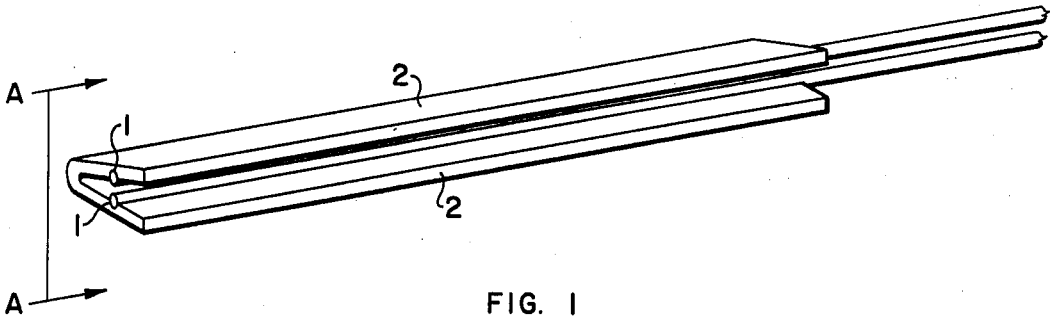
FIG. 1 show a pressure-operated tape switch in perspective.
Figure 2:
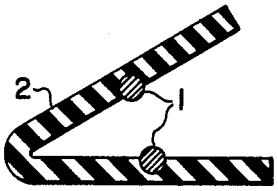
FIG. 2 shows a pressure-operated tape switch in the energized (with force on it) position.
Figure 2:
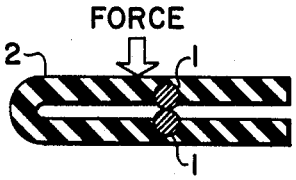

FIG. 1 shows a length of tape switch with the conductor contacts 1 inserted in the insulated synthetic material 2 opposite each other. The switch can be made of any length depending upon its use. When a force or pressure is applied to the tape switch FIG. 2 the normally-open contacts close and provide continuity to an external circuit connected electrically to either end of the switch. Normally the switch is used with voltages below 32 volts to provide either control, alarms, or monitoring functions. The switch can be made and installed in configurations for use in mats, pads, seats, roadways or other special monitor applications.

Figure 3:
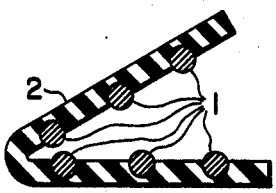
FIG. 3 shows a tape switch with three sets of contacts.

Special housings and coverings can be added for specialize hazard-proofing requirements and/or operations at higher electrical ratings. For specialized higher electrical ratings, materials for the conductors and insulator can be selected to provide a design to meet the necessary electric codes. The switch could be designed with a multiple number of contacts 1 as shown in FIG. 3 where three sets of contacts are used. This type of switch could be used where different degrees of control are necessary and would be dependent upon the degree of applied pressure.

Figure 5:
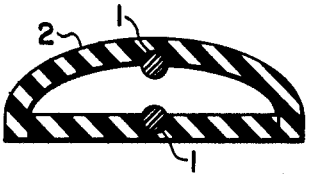
FIG. 5 shows another configuration of the tape switch with a curved section.
Figure 4:
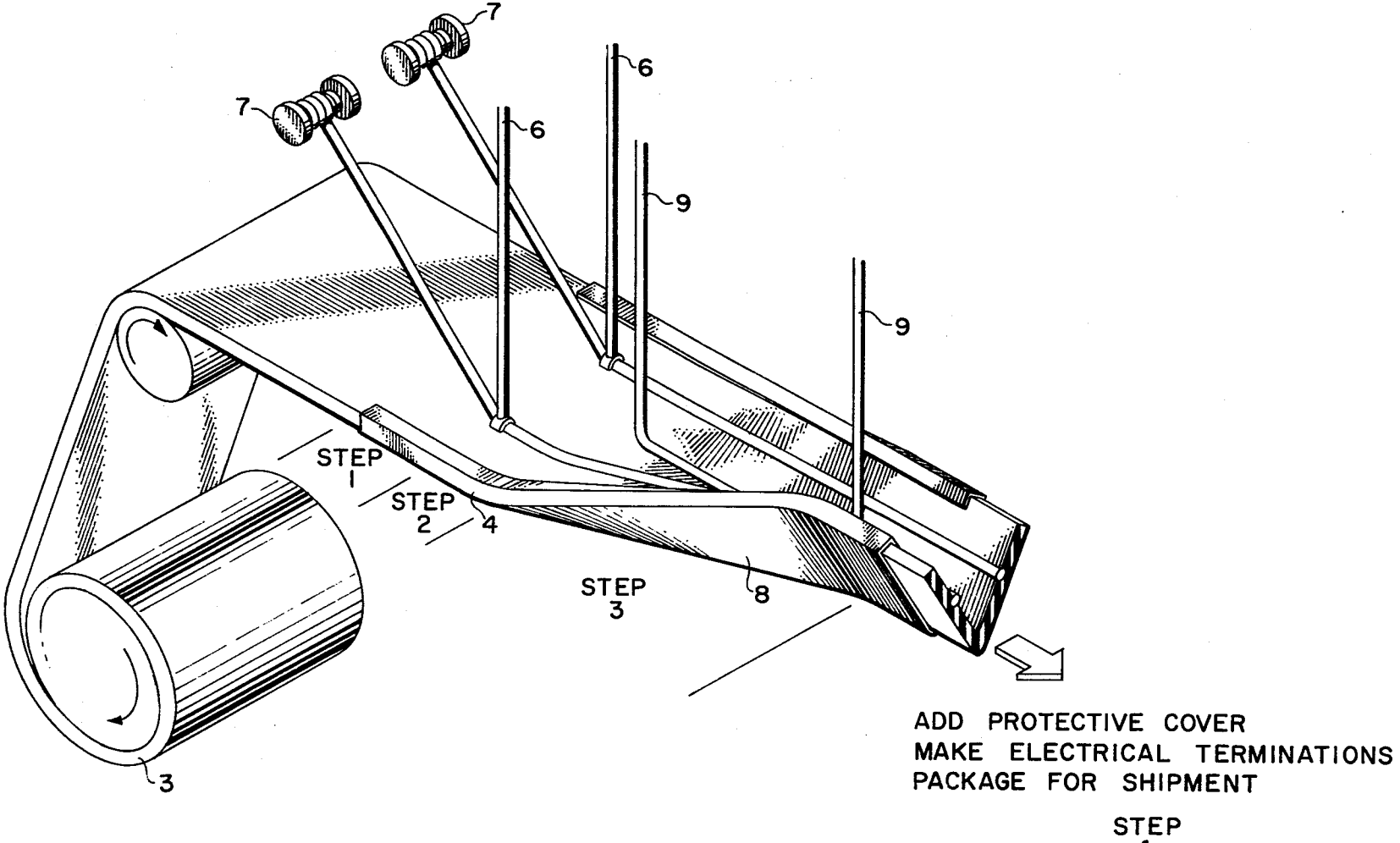
FIG. 4 shows the steps in a possible manufacturing process.

The tape switch can be manufactured with a very small bend radius which is determined by the size and characteristics of the materials which make up the switch. This bend radius would provide the versatility necessary in some security monitor circuits to go around sharp corners and edges. Another possible use for the small bend radius might be a tape switch manufactured with conductors of small diameters and high resistivity. The tape switch might be rolled-up and used in the same fashion as a tape measure. As the tape switch is reeled out, its resistance would vary proportionately with distance. This could be connected to an external circuit to read out distance directly or fed to a control circuit for feed-back purposes. The ease of altering the tape switch for specialize design applications would not be possible if it were not for the simplicity of fabrication of the tape switch. This is probably the primary advantage this tape switch has over any other competitor. All the components which go into the construction of this tape switch can be bought in bulk form from many different manufacturers which is one factor in its low cost. The other factor is the manufacturing process itself. FIG. 4 shows four possible steps taken in manufacturing the tape switch. Step 1 shows a roll 3 of synthetic insulation material in bulk form being placed between two side support guides 4 on a conveyor, which provides movement of the material down the assembly line. Next is step 2 where the insulated material 2 is treated to accept the conductor contacts. There are other techniques to attach the conductors to the insulated material, but this illustrates what is considered one of the least expensive methods. In this method two conductors are pressed unto the insulator by two probes 6 which were aligned for the proper contact spacing prior to the run. Each probe has just enough pressure and heat at its tip to set the conductors into the synthetic material at a depth to hold it in place and yet provide enough surface exposure for proper continuity. In this example bare stainless steel wire is used, but a conductor of any type or shape could be used depending upon the application. The conductors are shown unwinding from the rolls 7 in which they were shipped. In another technique two slots might be cut into the insulation material. These slots are circular in size to accomodate the diameter of the conductor (In this application the conductor is round although any size or shape would work.) The slot opening is slightly less than the diameter inorder to hold the conductor in place with a griping action. Several ways are possible to cut the slots out. The most economical one would be to use some type of cutting tool or die. The other possibility would be to ream out the hole with a heated probe. A combination of both might work out even better. After the slots are made the conductors would be pressed into the openings. Step 3 is where the switch is shaped to its proper angle by passing through a form 8. A guide rod 9 is provided at the top center of the insulator to assist the bending action. The rod has an angular edge at its bottom which is heated to a temperature dependent upon the synthetic material used. As the material progresses down the form the angle is increased gradually until finally it is at the right angle. This shaping process can also be altered depending upon the size of the insulation material, perhaps the form might be heated or require some external pressure to assist the bending action. At step 4 any special requirements of the user are added. A special protective covering might be added or maybe special electrical terminations. This is where the tape switch can be put in rolls or packaged for shipment. The tape switch and its manufacturing process is not limited to the particular configuration shown in the present drawings and described herein. The synthetic material might be made with the insert slots and angle by an extrusion or molding process. Then it would only be necessary to insert the conductor contacts into the slots for a finished product. The switch could also be made in two separate sections and then joined together at the proper angle with a welding technique. This same welding technique could be used to join a straight section with a curve section, as shown in FIG. 5, to take advantage of the same switching action of the synthetic material, yet provide an enclosed switch.

What I claim is:

1. A tape switch comprising: an elongated narrow low profile angular shaped resilient insulated ribbon material; an electrical conductor secured on the base of the interior of said ribbon material; and a second electrical conductor secured on opposite interior surface of said ribbon material, opposite and parallel to said first electrical conductors; said conductors being spaced from each other an amount such that no electrical interconnection is provided therebetween so that deflection imparted to said ribbon switch by an object will cause a portion of said conductors to contact each other.

2. The combination as claimed in claim 1 wherein said angular shaped resilient insulated material is bent upon itself to form the necessary spring action required for proper switching.

3. The combination as claimed in claim 1 wherein said angular shaped resilient insulated material geometrical shape provides the necessary mechanical advantage and sensitivity to close said electrical conductors from weight of one ounce avoirdupois.

4. The combination as claimed in claim 1 wherein said angular material low profile prevents a rolling object from deviating from its path.

5. The combination as claimed in claim 1 wherein said electrical conductors are circular and are secured to said insulation material by slots, said slots are circular in shape to accomodate said conductors, said slot opening is slightly less than the diameter of said conductor to provide necessary gripping action, but large enough to provide switch contact surface area.

6. The combination as claimed in claim 1 wherein said electrical conductors are metallic foil, said metallic foil is held to insulated surface with an adhesive.

7. The combination as claimed in claim 1 wherein said electrical conductors is in the form of metallic paint applied to said insulated material.

8. A method of forming a long narrow continuous ribbon of synthetic insulation material into a tape switch, said method comprising the steps of:

inserting a pair of conductors, a predetermined depth and equally spaced from center-line of said insulation material with conductor inserting probes;

forming said insulation material into an angular shape using two side support guides, a form and center-line guide rod.

9. A method as defined in claim 8 in which said conductors inserting probes apply a predetermined amount of heat and pressure to set conductors at proper position into said insulation material.

10. A method as defined in claim 8 which further includes heating said form and said center-line guide rod to shape and set said insulation material into a predetermined angular shape.

11. A method as defined in claim 8 in which cutting tools are used in lieu of said heated inserting probes, said cutting tools providing grooves of the proper size and shape to accept said conductors at proper position on said insulation material.

* * * * *